US006543329B2

(12) United States Patent
Sanford et al.

(10) Patent No.: US 6,543,329 B2
(45) Date of Patent: Apr. 8, 2003

(54) NESTED RING BASED COUNTERMASS ASSEMBLY

(75) Inventors: Matthew J. Sanford, Bel Alton, MD (US); Gregory D. DuChane, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/244,272

(22) Filed: Sep. 16, 2002

(65) Prior Publication Data

US 2003/0005818 A1 Jan. 9, 2003

Related U.S. Application Data

(63) Continuation of application No. 09/708,252, filed on Nov. 8, 2000.

(51) Int. Cl.[7] ..... F41A 3/00; F41C 27/00
(52) U.S. Cl. ..... 89/1.701
(58) Field of Search ..... 89/1.701, 1.702; 102/437

(56) References Cited

U.S. PATENT DOCUMENTS

| | | | | |
|---|---|---|---|---|
| 2,413,008 A | | 12/1946 | Taglialatela | 102/2 |
| 3,216,323 A | | 11/1965 | Wengenroth et al. | 89/1.7 |
| 3,771,417 A | | 11/1973 | Schnabele et al. | 89/1.701 |
| 3,796,128 A | | 3/1974 | Zeyher | 89/1.701 |
| 4,132,148 A | | 1/1979 | Meistring et al. | 89/1.701 |
| 4,643,071 A | | 2/1987 | Baechler et al. | 89/1.701 |
| 5,285,713 A | | 2/1994 | Brage | 89/1.704 |
| 5,337,648 A | | 8/1994 | Brage | 89/1.704 |
| 5,357,841 A | | 10/1994 | Clark et al. | 89/1.701 |
| 5,551,330 A | * | 9/1996 | Reuche | 89/1.701 |
| 5,807,159 A | | 9/1998 | Watkins | 446/475 |
| 5,915,694 A | | 6/1999 | Brum | 273/359 |
| 6,286,408 B1 | | 9/2001 | Sanford et al. | 89/1.701 |
| 6,446,535 B1 | * | 9/2002 | Sanford et al. | 89/1.701 |

* cited by examiner

*Primary Examiner*—Michael J. Carone
*Assistant Examiner*—M. Thomson
(74) *Attorney, Agent, or Firm*—James B. Bechtel, Esq; Matthew J. Bussan, Es; Peter J. Van Bergen, Esq.

(57) ABSTRACT

A countermass assembly is axially and radially restrained while within a vessel and is dispersible into its component parts upon being ejected from the vessel into an open environment. A plurality of groups arranged axially adjacent one another to form a stack. Each group is formed from a plurality of rings arranged in a nested interengagement. Each ring is an individual ring that is in a non-binding relationship with adjacent rings. The non-binding relationship allows each ring to be separable as such from its associated group when the stack is ejected from the vessel into the open environment.

23 Claims, 4 Drawing Sheets

NESTED RING BASED COUNTERMASS ASSEMBLY

This is a continuation application of co-pending application Ser. No. 09/708,252 filed Nov. 8, 2000.

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to countermass assemblies, and more particularly to a countermass assembly made from a stack of nested rings.

BACKGROUND OF THE INVENTION

A variety of countermass materials and assemblies are known in the art. Materials include fluids and fluid-like substances and mixtures, powders, granular mixtures, flakes, prestressed and readily-fragmentizing glass, flying objects and exploding objects, just to name a few. Many of these materials are inappropriate for the development of a countermass designed to be launched from within a confined space. Fluid-based countermasses tend to have a low density thereby requiring a large volume to be effective. Fluids are also vulnerable to freezing and evaporating at the wide range of temperatures and storage typically required of a weapon. Mixtures of solids and fluids present settling problems in addition to the fluid related problems, as well as viscosity problems and poor dispersion characteristics. Powders tend to produce high side loads on the launch tube and do not flow out of a nozzle cleanly. Other designs have problems with stability under the high acceleration forces during ejection, resulting in breakage and buckling of the countermass. Further, many materials are not suitable for dispersion due to their inherent hazardous nature (e.g., fragmentizing glass), environmental and/or health concerns.

SUMMARY OF THE INVENTION

Accordingly, it is an object of the present invention to provide a countermass assembly.

Another object of the present invention to provide a countermass assembly that is stable prior to deployment.

Still another object of the present invention to provide a countermass assembly that exits a launch tube cleanly and completely.

Yet another object of the present invention to provide a countermass assembly that disperses safely into the environment.

Still another object of the present invention to provide a countermass assembly that is not toxic to personnel or the environment.

A further object of the present invention to provide a countermass assembly that makes efficient use of space.

Other objects and advantages of the present invention will become more obvious hereinafter in the specification and drawings.

In accordance with the present invention, a countermass assembly is provided that is axially and radially restrained while within a vessel, and that is dispersible into its component parts upon being ejected from the vessel into an open (air) environment. The countermass assembly comprises a plurality of groups arranged axially adjacent one another to form a stack having a common longitudinal axis. Each group is formed from a plurality of rings arranged in a nested interengagement. Each ring is an individual ring that is in a non-binding relationship with adjacent rings. In this way, each ring is separable as such from its associated group when the stack is ejected from the vessel into the open environment. The separated rings quickly decelerate and flutter harmlessly through the air.

DETAILED DESCRIPTION OF THE INVENTION

Figure 1:
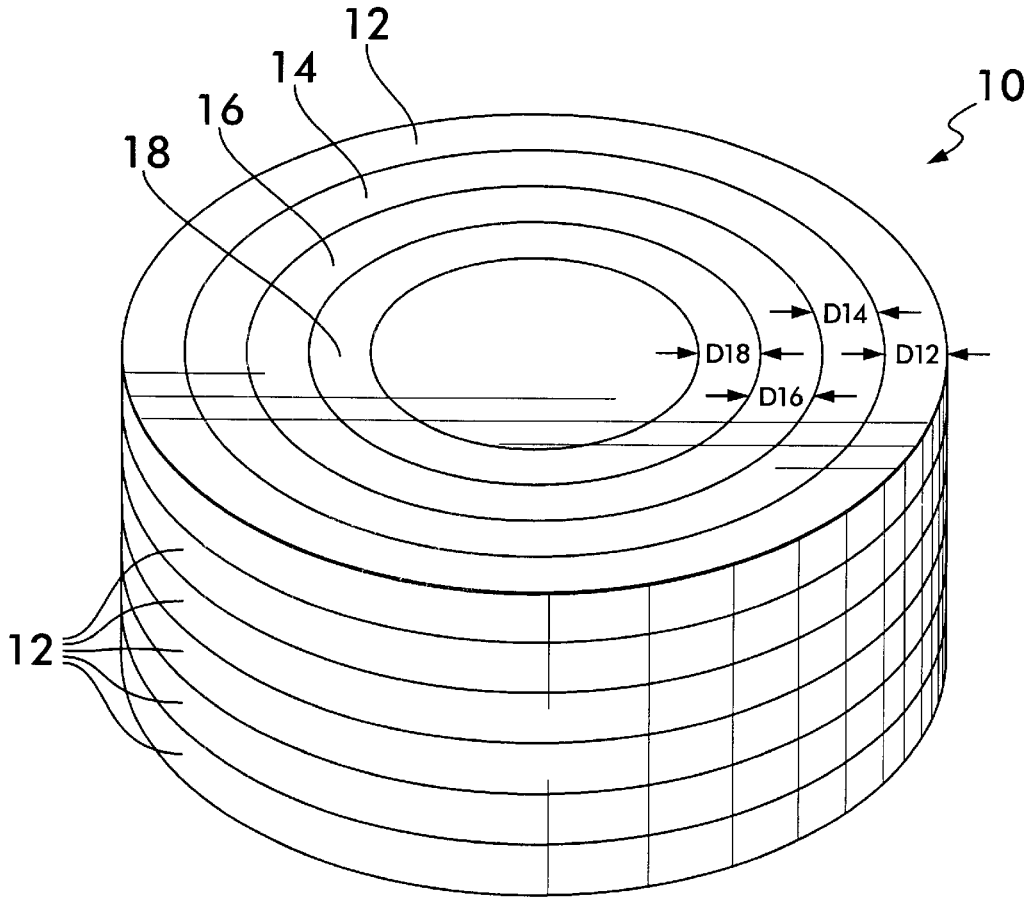
FIG. 1 is a perspective view of a stack of nested ring assemblies forming a countermass assembly according to one embodiment of the present invention.

Referring now to the drawings, and more particularly to FIG. 1, an embodiment of a countermass assembly according to the present invention is shown and referenced generally by numeral 10. Countermass assembly 10 is a dispersible countermass that can be used in a variety of guns or other launch systems, the choice of which in no way limits the scope of the present invention.

Countermass assembly 10 is a layered stack of nested rings. More specifically, each layer of countermass assembly 10 consists of a series of individual rings 12, 14, 16 and 18 successively nested with one another. Only the top layer is visible in FIG. 1. Although four such rings are shown in each layer of the illustrated embodiment, more or fewer individual rings can be used. The diametric thickness (i.e., $D_{12}$, $D_{14}$, $D_{16}$, $D_{18}$) of each ring can be the same or different. At the center of each layer, a disk 20 can optionally be nested with the innermost ring 18 to completely fill the available countermass space.

Rings 12, 14, 16, 18 and disk 20 are positioned in a nested relationship as shown, and are maintained in countermass assembly 10 by means of a gun barrel or launch tube (not shown). That is, the relationship between adjacent rings and ring 18/disk 20 is not a binding or press-fit relationship. Rather, only the gun barrel or launch tube restrains axial and radial movement of the rings and disks until assembly 10 is ejected therefrom.

Figure 2:
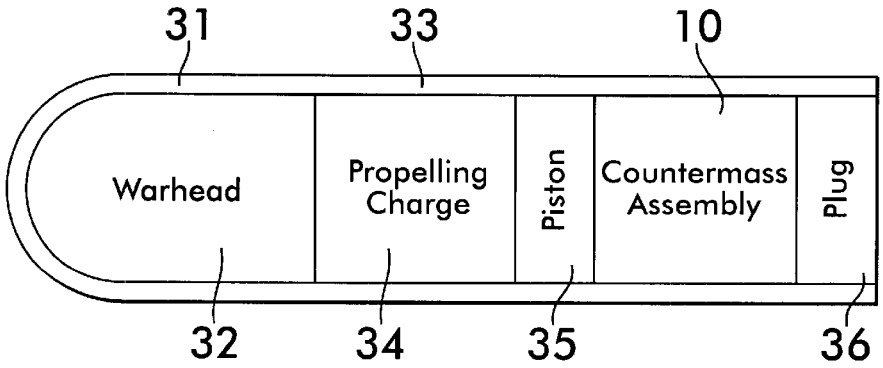
FIG. 2 is a side view of a shoulder-launched projectile housing the nested ring countermass assembly in the pressure vessel of the projectile.

By way of example, FIG. 2 illustrates one use of the present invention. A projectile that is to be fired from a shoulder-held launcher is shown and referenced generally by numeral 30. The launching of projectile 30 typically occurs in a small or confined space. Thus, it is desirable to use a countermass assembly made from inert and harmless material that decelerates quickly when expelled or ejected into the surrounding open environment thereby reducing or eliminating the possibility of injury to personnel in the vicinity of the launch. In general projectile 30 includes a warhead case 31 filled with an explosive material 32. Coupled to warhead case 31 is a pressure tube or vessel 33 housing a propelling charge 34, a piston 35, a nested ring countermass assembly (e.g., countermass assembly 10) radially restrained by pressure vessel 33, and a retaining plug 36. Before firing of propelling charge 34, piston 35 and retaining plug 36 axially restrain countermass assembly 10.

Figure 3:
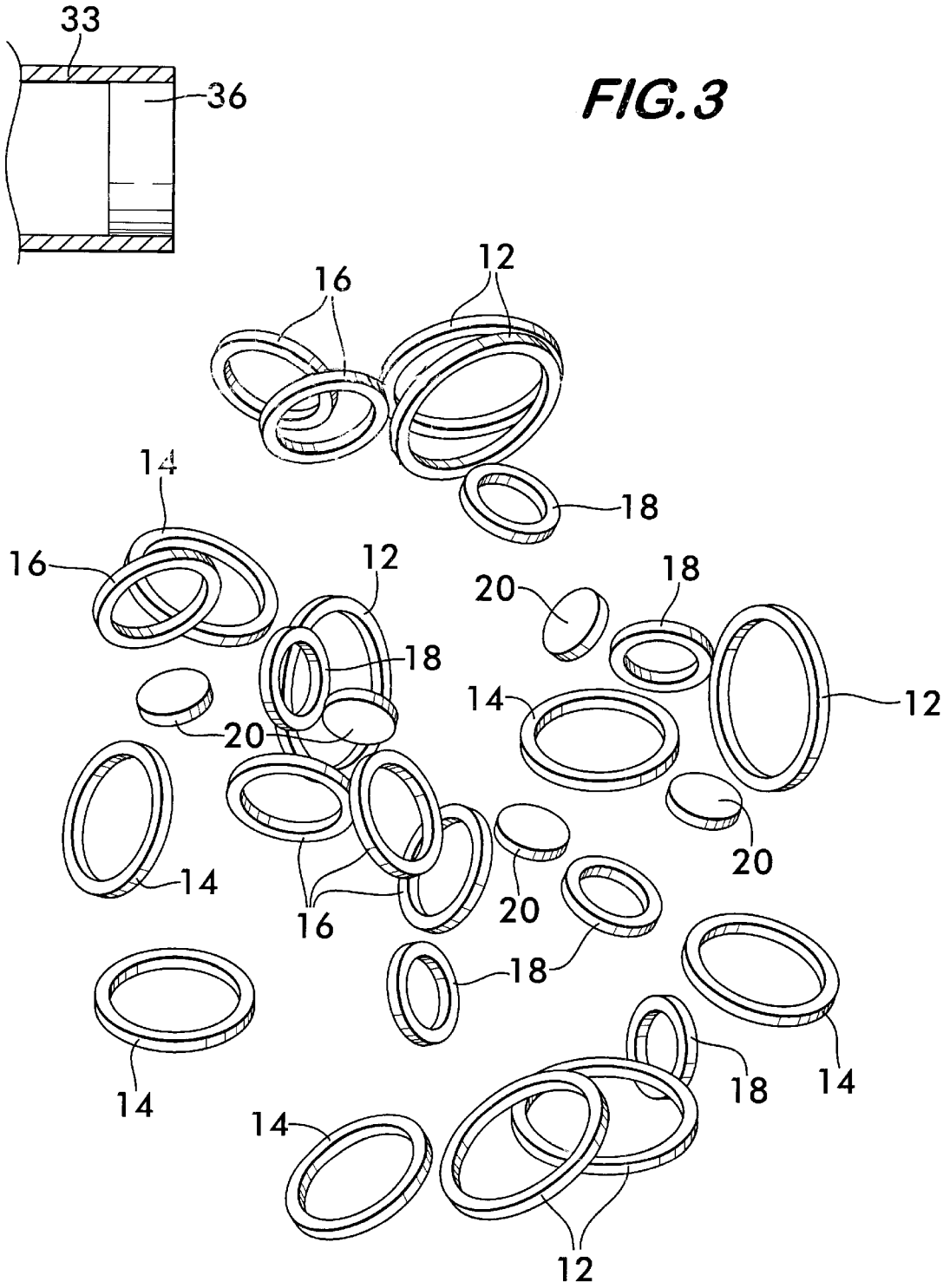
FIG. 3 is a perspective view of the countermass assembly of FIG. 1 once it has been ejected into an open environment from the aft end of the pressure vessel shown in FIG. 2.

In operation, when propelling charge 34 is fired, warhead casing 31 and pressure vessel 33 are driven to the left while piston 35, countermass assembly 10 and plug 36 are driven to the right. Countermass assembly 10 is only held together radially and axially by the combination of pressure vessel 33, piston 35 and plug 36. Therefore, when countermass assembly 10 is pushed to the right by piston 35 and ejected from the aft end of pressure vessel 33 into the surrounding open environment (e.g., air), rings 12, 14, 16, 18 and disks 20 disperse from their configuration as assembly 10 where the rings flutter as individual rings due to their aerodynamically unstable shape as illustrated in FIG. 3.

Figure 4:
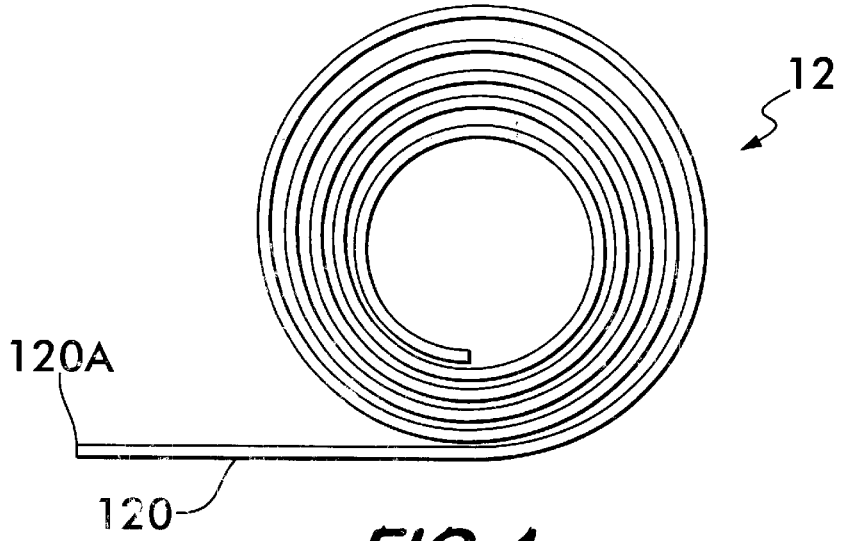
FIG. 4 is a side view of one ring of the countermass assembly constructed as a roll of a strip material.

Some or all of rings 12, 14, 16, 18 and disks 20 can be solid or can be made of a strip material that is wound similar to a roll of tape. For example, as illustrated in FIG. 4, one ring 12 is shown as being constructed of a strip 120. The outboard end 120A of strip 120 can be lightly tacked to the outermost winding of ring 12 to keep the ring configuration during assembly. When the rings (or disks 20) are constructed in this fashion, the strips will tend to unfurl as the rings and disks disperse. The unfurling of each ring and/or disk further slows their velocity as the unfurling strip material presents more surface area thereby increasing its aerodynamic instability.

Figure 5:
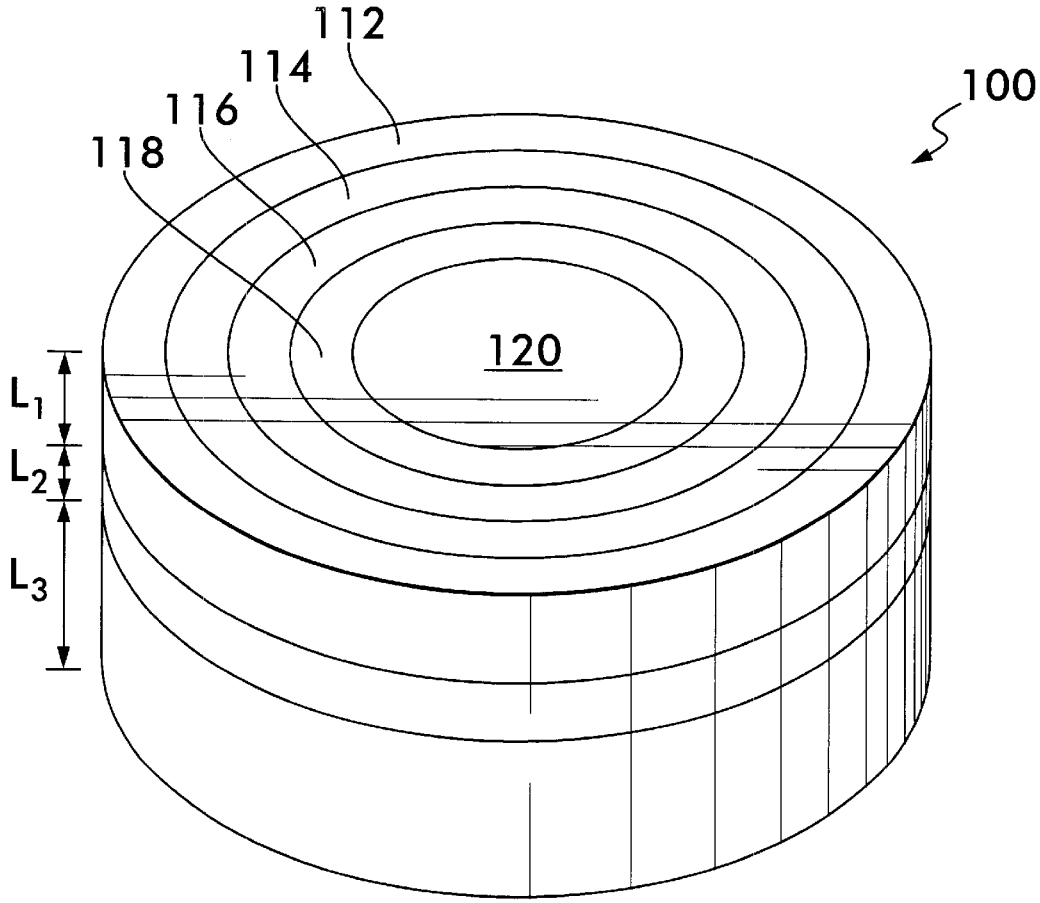
FIG. 5 is a perspective view of another embodiment of the present invention in which each layer of rings has a different axial length.

Each ring and disk in countermass assembly 10 has the same axial length. However, the present invention could also be made with layers of differing axial length as illustrated by countermass assembly 100 in FIG. 5. Specifically, a first layer of axial length $L_1$ consists of rings 112, 114, 116, 118 and disk 120. A second layer of similar rings/disk has an axial length $L_2$, and a third layer of similar rings/disk has an axial length $L_3$. These lengths can be selected so that the countermass disperses in an optimal fashion for a particular application. Note that the axial lengths could also successively increase, successively decrease, or be random in length depending on the application.

Figure 6:
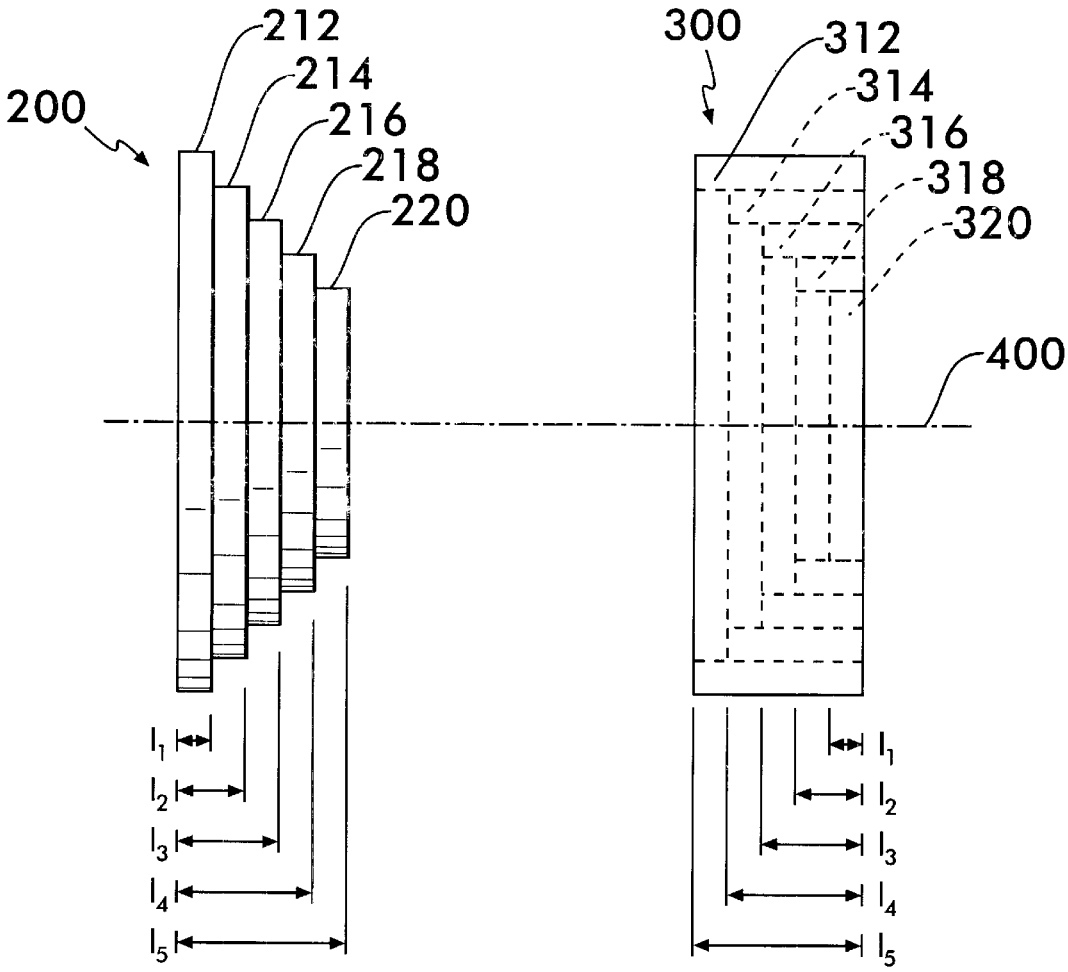
FIG. 6 is an exploded side view of another embodiment of the present invention in which adjacent layers of nested rings are radially interlocked.

The present invention could also be made by radially interlocking adjacent layers of nested rings as shown in the exploded view of FIG. 6. More specifically, layers 200 and 300 are shown separated from one another along a common longitudinal axis 400. As in the previous embodiments, each layer consists of nested rings with an optional central disk. However, the axial length of each ring/disk in a layer is varied to complement an adjacent ring/disk. For example, layer 200 has rings 212, 214, 216, 218 and disk 220 at its center. Layer 300 has rings 312, 314, 316, 318 and disk 320 at its center. The lengths of rings 212, 214, 216, 218 and disk 220 are $l_1$, $l_2$, $l_3$, $l_4$ and $l_5$, respectively. In a complementary fashion, the lengths of rings 312, 314, 316, 318 and disk 320 are $l_5$, $l_4$, $l_3$, $l_2$ and $l_1$, respectively. Thus, when layers 200 and 300 are pressed into axial engagement along axis 400, layers 200 and 300 will be radially interlocked with one another.

The advantages of the present invention are numerous. The nested ring design will support a large axial load without buckling. Additionally, the circular design is optimal for supporting a tangential or hoop load when the stack is compressed axially during launch. Despite the compression-stable qualities of the stack of nested rings, they will disperse readily upon release. Additionally, the rings can be fabricated from a wide variety of materials. The strip/roll version may provide less of a threat to bystanders. In addition, the fabrication and assembly are not complicated or sensitive to minor size or material variations.

The countermass assembly of the present invention is easily made chemically inert and non-toxic. The design lends itself to being made form a variety of materials that are insensitive to changing and/or extreme temperatures. In addition, the use of nested rings and a central disk provides a space efficient design.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A countermass assembly that is axially and radially restrained while within a vessel and that is dispersible into its component parts upon being ejected from the vessel into an open environment, said countermass assembly comprising:

a plurality of groups arranged axially adjacent one another to form a stack having a common longitudinal axis; and each of said plurality of groups having a plurality of rings arranged in a nested interengagement, each of said plurality of rings being an individual ring in a non-binding relationship with adjacent ones of said plurality of rings and separable as such from its associated one of said plurality of groups when said stack is ejected from the vessel into the open environment.

2. A countermass assembly as in claim 1 wherein at least a portion of said plurality of rings comprise a roll of strip material.

3. A countermass assembly as in claim 1 further comprising a disk nested into a center of each of said plurality of groups.

4. A countermass assembly as in claim 3 wherein at least a portion of said plurality of rings comprise a roll of strip material.

5. A countermass assembly as in claim 3 wherein said disk comprises a roll of strip material.

6. A countermass assembly as in claim 1 wherein axially adjacent groups from said plurality of said groups are radially interlocked with one another.

7. A countermass assembly as in claim 6 wherein at least a portion of said plurality of rings comprise a roll of strip material.

8. A countermass assembly as in claim 1 wherein an axial length of each of said plurality of groups is the same.

9. A countermass assembly as in claim 8 wherein at least a portion of said plurality of rings comprise a roll of strip material.

10. A countermass assembly as in claim 1 wherein an axial length of each of said plurality of groups is different.

11. A countermass assembly as in claim 10 wherein at least a portion of said plurality of rings comprise a roll of strip material.

12. A countermass assembly that is axially and radially restrained while within a vessel and that is dispersible into its component parts upon being ejected from the vessel into an open environment, said countermass assembly, comprising:

a plurality of groups arranged axially adjacent one another to form a cylindrical stack having a common longitudinal axis; and each of said plurality of groups having a plurality of circular rings arranged in a nested interengagement that defines a central axial void fitted with a disk, each of said plurality of circular rings being an individual circular ring in a non-binding relationship with adjacent ones of said plurality of rings and separable as such from its associated one of said plurality of groups when said stack is ejected from the vessel into the open environment.

13. A countermass assembly as in claim 12 wherein each of said plurality of circular rings comprises a roll of strip material that is free to unfurl when disengaged from said stack.

14. A countermass assembly as in claim 12 wherein said disk comprises a roll of strip material that is free to unfurl when disengaged from said stack.

15. A countermass assembly as in claim 12 wherein axially adjacent groups from said plurality of said groups are radially interlocked with one another.

16. A countermass assembly as in claim 15 wherein each of said plurality of circular rings comprises a roll of strip material that is free to unfurl when disengaged from said stack.

17. A countermass assembly as in claim 15 wherein said disk comprises a roll of strip material that is free to unfurl when disengaged from said stack.

18. A countermass assembly as in claim 12 wherein an axial length of each of said plurality of groups is the same.

19. A countermass assembly as in claim 18 wherein each of said plurality of circular rings comprises a roll of strip material that is free to unfurl when disengaged from said stack.

20. A countermass assembly as in claim 18 wherein said disk comprises a roll of strip material that is free to unfurl when disengaged from said stack.

21. A countermass assembly as in claim 12 wherein an axial length of each of said plurality of groups is different.

22. A countermass assembly as in claim 21 wherein each of said plurality of circular rings comprises a roll of strip material that is free to unfurl when disengaged from said stack.

23. A countermass assembly as in claim 21 wherein said disk comprises a roll of strip material that is free to unfurl when disengaged from said stack.

* * * * *